US005816749A

United States Patent [19]

Bailey, II

[11] Patent Number: 5,816,749

[45] Date of Patent: Oct. 6, 1998

[54] MODULAR BLOCK RETAINING WALL SYSTEM

[75] Inventor: Joseph S. Bailey, II, Roswell, Ga.

[73] Assignee: The Tensar Corporation, Atlanta, Ga.

[21] Appl. No.: 716,626

[22] Filed: Sep. 19, 1996

[51] Int. Cl.[6] ..... E04C 1/00; E02D 17/20

[52] U.S. Cl. ..... 405/286; 405/284; 52/603; 52/604; 52/605

[58] Field of Search ..... 405/284, 286, 405/262; 52/603, 604, 605, 607, 283, 284, 286

[56] References Cited

U.S. PATENT DOCUMENTS

| | | | |
|---|---|---|---|
| D. 279,030 | 5/1985 | Risi et al. | D25/113 |
| D. 301,063 | 5/1989 | Risi et al. | D25/113 |
| 4,273,476 | 6/1981 | Kotulla et al. | 405/284 X |
| 4,374,798 | 2/1983 | Mercer | 264/288.8 |
| 4,490,075 | 12/1984 | Risi et al. | 405/273 |
| 4,860,505 | 8/1989 | Bender | 405/286 |
| 5,064,313 | 11/1991 | Risi et al. | 405/284 |
| 5,248,226 | 9/1993 | Risi et al. | 405/284 |
| 5,540,525 | 7/1996 | Miller et al. | 405/284 |
| 5,595,460 | 1/1997 | Miller et al. | 405/284 |
| 5,598,679 | 2/1997 | Orton et al. | 405/284 X |
| 5,619,835 | 4/1997 | Bailey, II et al. | 52/606 |
| 5,673,530 | 10/1997 | Bailey, II | 52/606 |

*Primary Examiner*—Tamara L. Graysay
*Assistant Examiner*—Tara L. Mayo
*Attorney, Agent, or Firm*—Jacobson, Price, Holman & Stern, PLLC

[57] ABSTRACT

A modular wall block is formed with two integral, transverse projections extending upwardly from its top surface, spaced from the front face of the block and spaced from each other by an upwardly opening groove. Each block also includes two downwardly opening, transversely extending, grooves of different widths spaced from the front face and spaced from each other by a downwardly extending projection. The width of the downwardly extending projection and the upwardly opening groove are approximately the same and the combined distance between the extreme edges of the two upwardly extending projections is substantially equal to the width of the larger of the two downwardly opening grooves. The height of the upwardly extending projections is equal to or less than the depth of the two downwardly opening grooves. By this arrangement, it is possible to selectively superimpose such blocks in a manner which either positions the front faces of superior blocks in a vertically aligned orientation or a vertically set-back orientation. An optional recessed area located in the upper surface behind the two projections is adapted to receive a grid-like sheet of reinforcing material which is captured therein by the lower surface of a superimposed block. The blocks of this application are dimensioned to be integrated in a retaining wall constructed of a mixture of these blocks and more robust modular wall blocks interconnected by a comb-like device. Multiple wall blocks are simultaneously formed on their side to enhance the high speed molding techniques.

26 Claims, 7 Drawing Sheets

MODULAR BLOCK RETAINING WALL SYSTEM

FIELD OF THE INVENTION

This invention relates to a modular wall block system, methods and apparatus for making the wall blocks, and retaining walls formed therefrom. The wall blocks of this invention are designed for ease in positioning and locating individual blocks relative to each other in one of a vertically aligned or a vertically staggered orientation during construction of civil engineering structures. Relatively low retaining walls may be made entirely of the inventive blocks, with or without tie-backs such as reinforcing sheets of grid-like material. Additionally, the blocks of this invention are adapted for use with earlier modular wall blocks of a more robust nature for producing less expensive retaining walls in more critical environments or to add architectural interest to walls built with a mixture of such blocks.

BACKGROUND OF THE INVENTION

Retaining walls are commonly used for architectural and site development applications. Use of full height pre-cast concrete wall panels for wall-facing elements in a retaining wall requires, during construction, that the panels be placed using a crane because they are very large, perhaps 8 by 12 feet or even larger and, as a result, are quite heavy such that they cannot be readily manhandled. To avoid such problems in the use of pre-cast wall panels other types of retaining wall structures have been developed. For example, retaining walls have been formed from modular wall blocks which are typically relatively small as compared to cast wall panels. The assembly of such modular wall blocks usually does not require heavy equipment. Such modular wall blocks can be handled by a single person and are used to form retaining wall structures by arranging a plurality of blocks in courses superimposed on each other, much like laying of brick or the like. Each block includes a body with a front face which forms the exterior surface of the formed retaining wall.

Heretofore, modular wall blocks have been formed of concrete, commonly mixed in a batching plant with only enough water to hydrate the cement and hold the unit together. Such blocks have been commercially made with the surfaces intended to form the top and bottom of the wall block extending generally horizontally. The high-speed manufacturing process which provides a mold box having only sides, without a top or bottom, positioned on top of a steel pallet which underlies the mold box to create a temporary bottom plate. A concrete distributor box brings concrete from the batcher and places the concrete in the mold box and includes a blade which levels the concrete across the open top of the mold box. A stripper/compactor is lowered into the open, upper end of the box and contacts the concrete to imprint the block with a desired pattern and compresses the concrete under high pressure. The steel pallet located at the bottom of the mold box resists this pressure.

A vibrator then vibrates the mold box to aid in concrete consolidation. After approximately two to four seconds, the steel pallet is moved away from the bottom of the mold box which has been positioned above a conveyor belt. The stripper/compactor continues to push on the formed concrete to push the modular wall block out of the mold box onto the conveyor belt. This process takes about seven to nine seconds to manufacture a single wall block. The formed wall block is cured for approximately one day to produce the final product.

It is possible during such high speed processing to incorporate a recess or protrusions in the upper or lower surface of blocks, for example, to accommodate a sheet of earth reinforcing grid between superimposed courses of blocks. The end portions of a sheet of reinforcing grid may be retained by relying primarily on the weight of superimposed blocks to provide a frictional engagement over a large surface area of the sheet material; additionally, or alternatively, various mechanical connections have been proposed to secure the grid-like sheets to the wall blocks for reinforcing the fill material behind the retaining wall.

Improved modular wall block systems, as well as methods of making such wall blocks and retaining walls formed therefrom, are disclosed in commonly assigned U.S. Pat. No. 5,540,525 issued Jul. 30, 1996, and co-pending, commonly assigned U.S. patent application Ser. Nos. 08/370,324 filed Jan. 10, 1995 , now U.S. Pat. No. 4,860,505, and 08/591,266 and 08/591,319, both filed Jan. 25, 1996, the disclosures of all of which are incorporated herein in their entirety by reference. These wall blocks include the use of a comb or connector which includes a multiplicity of downwardly extending fingers or teeth adapted to engage in a transversely extending, upwardly opening groove in the top surface of a lower block to selectively secure grid-like sheets of retaining material thereto, with upwardly extending elongated tabs adapted to be received in a downwardly opening groove or slot in the bottom surface of a superimposed block to position or locate the front faces of upper courses of wall blocks relative to lower courses. Depending upon the selective orientation of the comb or connector the front faces of the blocks in superimposed courses may be vertically aligned or vertically offset.

While the modular wall block systems of U.S. Pat. No. 5,540,525 and the related co-pending, commonly assigned, applications, are particularly well adapted for the construction of relatively high retaining walls, or walls designed for critical civil engineering environments, there continues to be a need for a modular wall block system designed for relatively simple landscape applications or the like, one that is less expensive to manufacture and simpler and lighter in weight. Such a modular wall block system would be particularly attractive if it were adapted for the construction of retaining walls, with or without reinforcing grid materials, depending upon the height of the wall or the environment in which it was to be constructed, and if multiple wall blocks could be simultaneously manufactured in a high speed manner.

Additionally, a modular wall block system having these attributes, which was also capable of integration in retaining walls built from the modular wall blocks of U.S. Pat. No. 5,540,525 and the related applications identified above, would be especially commercially desirable to minimize the costs of such constructions where possible, and to permit walls built from such blocks to incorporate the modified blocks for architectural embellishment.

SUMMARY OF THE INVENTION

A primary object of this invention is the provision of a modular wall block system, a method and apparatus for making such blocks, and retaining walls built therefrom, which satisfy all of the foregoing desiderata, and others. Thus, the modular wall blocks of this invention are preferably smaller and lighter in weight than the previous design. Further, each wall block includes integral positioning or locating projections extending upwardly from its top surface which cooperate with downwardly opening grooves in the bottom surface of juxtaposed blocks to selectively position the front faces of superimposed courses either vertically aligned or offset rearwardly. This avoids the need for extraneous connector devices where the nature of the retaining wall does not require same. However, the projections and grooves are preferably dimensioned to coordinate with the width of the tabs on the connector combs of the earlier modular wall blocks so as to enable the integration of the different forms of wall blocks in a common retaining wall, if desired, without losing the ability to selectively align or offset the front faces by manipulating the orientation of the comb.

According to a preferred embodiment of the instant inventive concepts, each modular wall block is formed with a pair of integral projections extending upwardly from its top surface, transversely across the block, and spaced from each other and from the front face of the block. Each block is also formed with a pair of downwardly opening grooves in its bottom surface, extending transversely across the block, and spaced from each other and from the front face. The upwardly extending projections define between them an upwardly opening groove, and the downwardly opening grooves define between them a downwardly extending projection. The width of the upwardly opening groove separating the two upwardly extending projections is substantially equal to the width of the downwardly extending projection separating the two downwardly opening grooves. The downwardly opening groove closest to the front face of the block has a width equal to or slightly larger than the width of the upwardly extending projection located closest to the front face. The width of the second or rearmost downwardly opening groove is sufficient to encompass both of the upwardly extending projections. By this arrangement, the front faces of superimposed blocks may be selectively positioned in either a vertically aligned or a vertically staggered orientation using only the integrally formed projections and grooves as the locating means.

To position the superimposed courses of blocks with their front faces in a vertically offset orientation, each superior block is positioned such that its downwardly extending projection separating the downwardly opening grooves in its lower surface is engaged in the upwardly opening groove separating the upwardly extending projections in an inferior block, i.e., each of the upwardly extending projections in the lower block is received in a different downwardly opening groove in the superimposed block. To vertically align the front faces of superimposed courses of blocks, the superior block is positioned such that both of the upwardly extending projections on an inferior block fit within the rearward most downwardly opening groove in the lower surface.

The height of the upwardly extending projections is equal to or less than the depth of the two downwardly opening grooves and all of the projections and grooves preferably extend across the entire width of each block to enable blocks to be slid laterally to adjust the lateral orientation of the blocks in superimposed courses.

Not only is the width of the larger downwardly opening groove generally the same as the combined width of the pair of upwardly extending projections on each of the blocks of this invention, it is preferably generally the same as the width of the elongated tabs on the connector comb of the aforementioned earlier modular wall block systems so that courses of both types of blocks may be freely inter engaged in building retaining walls for certain applications.

By dimensioning the blocks of this invention of a similar depth, but of a width and height different from the modular wall blocks of the aforementioned commonly assigned patent and co-pending applications, selected courses of the different blocks may be integrated to provide a retaining wall with a decorative change in pattern, color or front face design for aesthetic or architectural contrast.

For that reason, each modular wall block of the present invention is preferably about 3⅝ inches high, or about half the height of the previous modular wall blocks, about 8 inches wide at its front face, again about half the width of the previous blocks, tapering on one side to about 6 inches wide at its rear face to permit a slight curvature to a retaining wall built therefrom, and about 12 inches deep, the same as the previous blocks. The weight of the blocks of this invention may vary depending upon the dimensions and the materials used, but these blocks are generally designed to weigh about 20 pounds, making them light enough to be stacked for constructing a retaining wall, even by a user of limited experience or strength.

It has been found that the high speed manufacturing techniques currently available can be enhanced by forming multiple wall blocks simultaneously on their side. This is accomplished by providing the mold box with liner and division plates defining the top and bottom projections of a series of double blocks, the underlying steel pallet and stripper compactor forming the sides of the double-blocks.

In many instances, particularly when constructing retaining walls of limited height or in non-critical situations, the courses of modular wall blocks need not be reinforced by tie-back sheets. For other applications, however, sheets of grid-like material may be interposed at selected levels to extend rearwardly from the retaining wall and thereby reinforce the mass of soil behind the wall in a well known manner. Thus, another object of this invention is to provide simple and inexpensive modular wall blocks which can optionally include a recess, which may be easily formed by the mold liner and division plates, for reception and retention of edge portions of extended lengths of grid-like reinforcing sheet material between selected courses of such blocks in a retaining wall built therefrom. Additionally, by integrating courses of wall blocks according to this invention with courses of the earlier wall block system, reinforcing grid sheets may be secured to the retaining wall by the comb connectors where necessary or desirable.

The term "grid-like sheet material" as used herein and the appended claims is to be understood as encompassing any continuous sheet material having one or more apertures formed therein in any conventional manner. Depending upon the particular application, preferred materials may be uniaxially or biaxially oriented integral structural geogrids or bonded composite open mesh structural textiles, of woven, non-woven and knitted construction. A description of preferred forms of all such materials is found in co-pending, commonly assigned U.S. patent application Ser. Nos. 08/643,182 filed May 9, 1996, and 08/696,604 filed Aug. 14, 1996, the subject matters of which are incorporated herein in their entirety by reference. The preferred form of uniaxially or biaxially oriented integral structural geogrids are commercially available from The Tensar Corporation of Atlanta, Ga. and are preferably made by the process disclosed in U.S. Pat. No. 4,374,798, the subject matter of which is also incorporated herein in its entirety by reference.

As described in U.S. Pat. No. 4,374,798, a high strength integral geogrid may be formed by stretching an apertured plastic sheet material. Utilizing the uniaxial techniques, a multiplicity of molecularly-oriented elongated strands and transversely extending bars which are substantially unoriented or less-oriented than the strands are formed in a sheet of high density polyethylene, although other polymer materials may be used in lieu thereof. The strands and bars together define a multiplicity of grid openings. With biaxial stretching, the bars are also formed into oriented strands.

For applications requiring high strength reinforcing materials, the preferred grid-like sheet is an integral uniaxially oriented geogrid. However, integral biaxial geogrids or grid materials that have been made by different techniques such as woven, knitted or netted grid materials formed of various polymers including the polyolefins, polyamides, polyesters and the like or fiberglass, may be used. In fact, any grid-like sheet materials, including steel (welded wire) grids are suitable. Also, for most applications, bonded composite open mesh structural textiles, woven, non-woven or knitted as disclosed in the aforementioned application Ser. Nos. 08/643,182 and 08/696,604 may be useful.

The above and other objects of the invention, as well as many of the attendant advantages thereof, will become more readily apparent when reference is made to the following detailed description, taken in conjunction with the accompanying drawings.

DETAILED DESCRIPTION OF THE PREFERRED EMBODIMENTS

Figure 1:
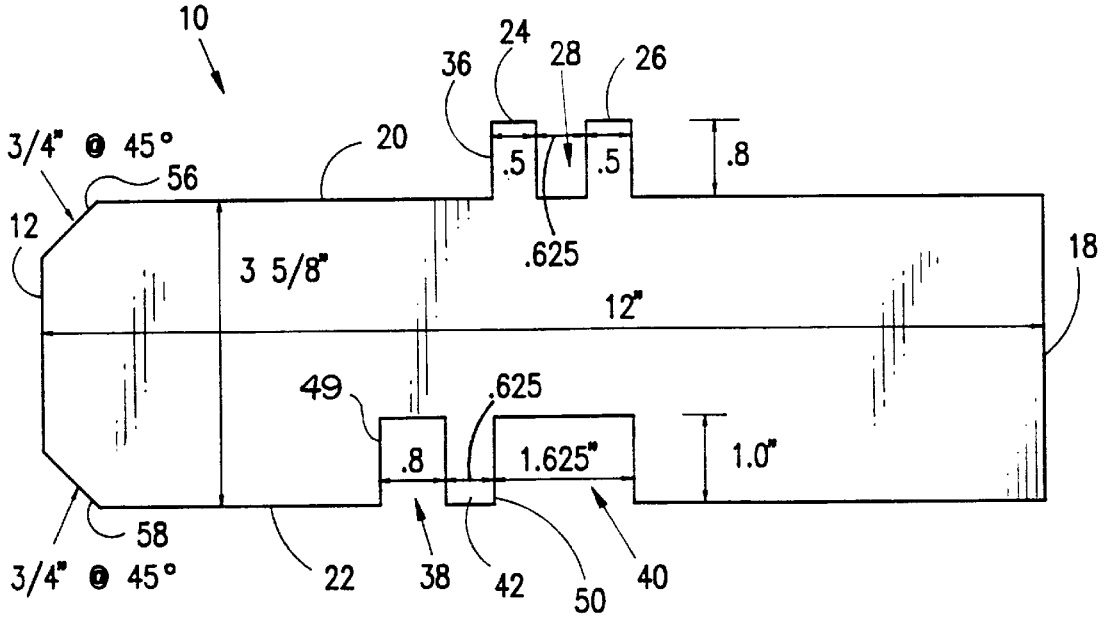
FIG. 1 is a schematic side elevational view of one form of a modular wall block according to the instant inventive concepts.

In describing preferred embodiments of the invention as illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose. Similarly, while preferred dimensions are set forth to describe the best mode currently known for the modular wall block system of this invention, these dimensions are illustrative and not intended to be limiting on the instant inventive concepts.

Figure 2:
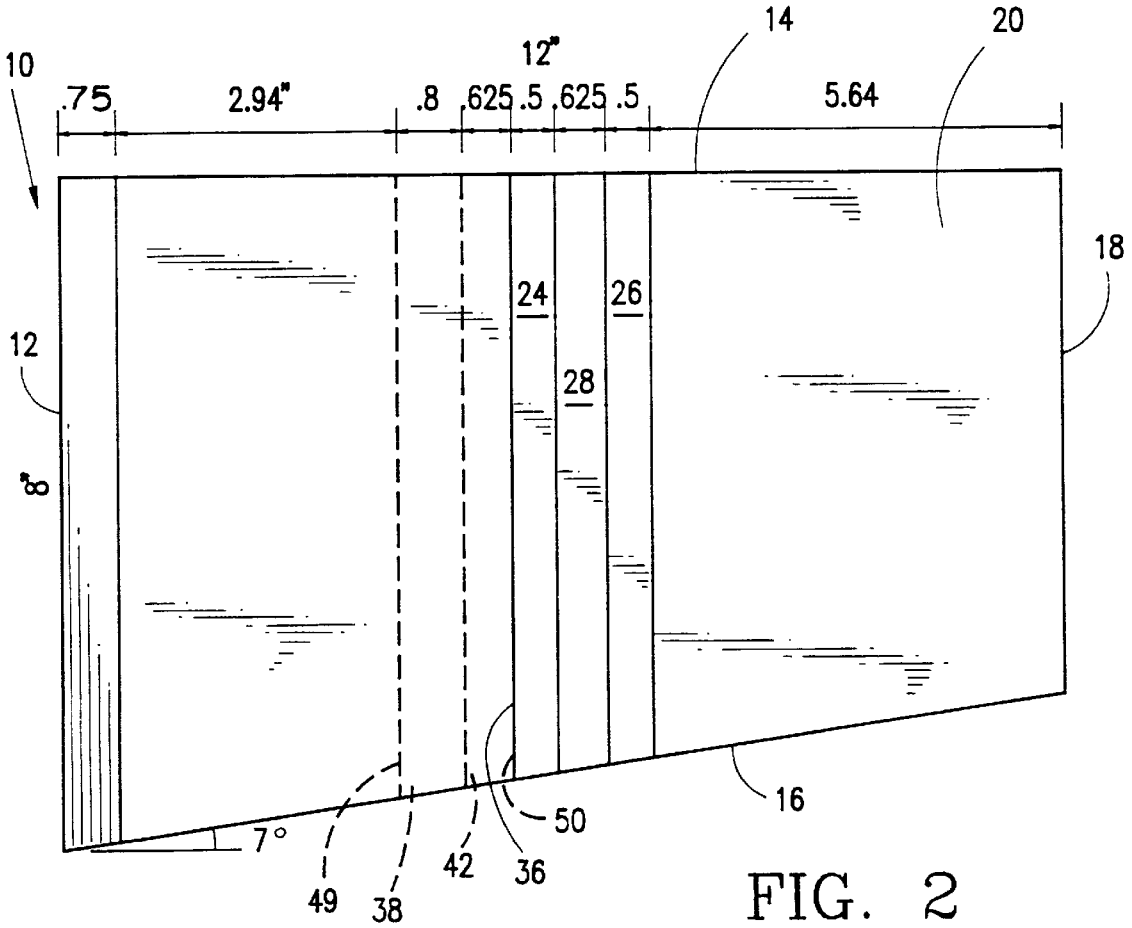
FIG. 2 is a top plan view thereof.
Figure 3:
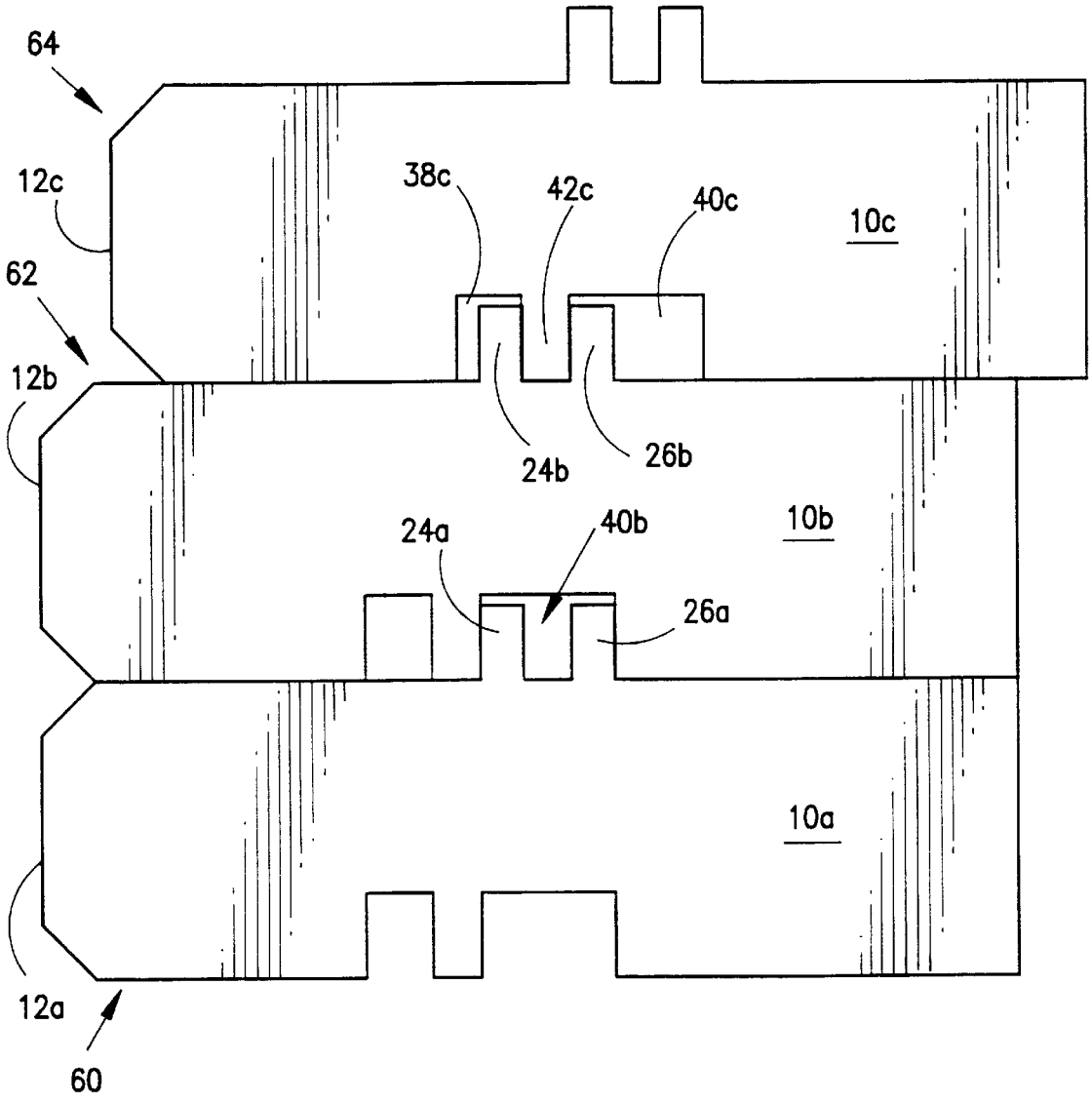
FIG. 3 is a schematic side elevational view showing the manner in which three courses of wall blocks may be stacked, the blocks of the lower two courses being superimposed with their front faces vertically aligned and the blocks of the upper two courses being superimposed with their front faces vertically offset for illustrative purposes.

With reference now to the drawings in general, and FIGS. 1 through 3 in particular, one embodiment of a modular wall block is schematically shown at 10 as comprising a front face 12, sidewalls 14, 16, a rear wall 18, an upper or top surface 20, and a lower or bottom surface 22. It is understood that the blocks 10 may be inverted in use, but the orientation shown in FIG. 1 facilitates integration with blocks utilizing a comb connector as discussed below with reference to FIGS. 4 and 5.

The front faces of the modular wall blocks can have any aesthetic or functional design. They can be planar, convex, concave, smooth, rough or have any configuration consistent with architectural or other requirements. In the embodiments shown, the front face is of a generally planar configuration.

Projecting from the upper surface 20 of the wall block 10 are two integral projections 24 and 26 which preferably extend transversely entirely across the block 10 as shown in FIG. 2. Separating the two projections 24 and 26 is an upwardly opening groove 28. Each of the projections 24 and 26 preferably have a width of about 0.50 inches and a height of about 0.8 inches. The projections 24, 26 are separated by the width of the groove 28, approximately 0.625 inches.

In this embodiment, the leading edge 36 of the projection 24 is spaced approximately 5.115 inches from front face 12. The total distance from the front of projection 24 to the rear of projection 26, including the groove 28 located therebetween, is approximately 1.625 inches.

On the lower surface 22 of the block 10 are two downwardly opening grooves 38 and 40. Extending downwardly between the two grooves 38 and 40 is a projection 42. The width of groove 38 is approximately 0.8 inches, whereas the width of groove 40 is approximately 1.625 inches, the same or slightly larger than the combined width of the two upwardly extending projections 24, 26. The width of projection 42 is approximately 0.625 inches, the same or slightly less than upwardly opening groove 28. Grooves 38 and 40 and projection 42 have a depth and height, respectively, of approximately 1.0 inch.

The leading edge 49 of groove 38 is located approximately 3.69 inches from the front face 12, whereas the leading edge 50 of groove 40 is located the same distance from the front face 12 as the leading edge 36 of projection 24, approximately 5.115 inches.

A typical block as shown in FIGS. 1 and 2 has an overall length from front face 12 to rear face 18 of about 12 inches and a height of about 3⅝ inches. The width of the block at front face 12 is about 8 inches across, whereas the width of the block at rear face 18 is approximately 6 inches. Side 16 is tapered at an angle of approximately 7° from front face 12 to enable a retaining wall with some curvature to be constructed with such blocks. In doing so, it may be necessary for portions of the projections 24, 26 or 42 to be knocked off selected walls to permit juxtaposed blocks to be angled slightly with respect to each other. The front face 12 includes upper and lower angled or slanted surfaces 56 and 58 merging with the top and bottom surfaces 20, 22, respectively, of the block 10. The tapered side 16 and the angled surfaces 56, 58 result from the preferred molding technique to be discussed in more detail hereinafter with reference to FIG. 9.

As shown in FIG. 3, the front faces of superimposed courses of wall blocks can be selectively arranged in a vertically aligned orientation or in a vertically offset orientation. For example, if it is desired that the front faces are to be vertically aligned as shown at 12*a* and 12*b* in courses 60 and 62 in FIG. 3, block 10*b* is positioned on block 10*a* such that the projections 24*a*, 26*a* of block 10*a* fit within the enlarged groove 40*b* of block 10*b*. Since the separation distance between the outermost surfaces of projections 24*a* and 26*a* is the about the same as the width of the groove 40*b*, the two projections fit within the groove and at the same time position the front faces 12*a* and 12*b* in a vertically aligned orientation.

If it is desired that the front faces are to be vertically offset as shown at 12*b* and 12*c* in courses 62 and 64 in FIG. 3, the downwardly extending projection 42*c* in the lower surface of block 10*c* is placed in the upwardly opening groove 28*b* between the projections 24*b* and 26*b* in the upper surface of block 10*b*. The projection 24*b* on block 10*b* is then located in groove 38*c*, whereas the projection 26*b* is located in groove 40*c*.

Of course, caps may be provided (not shown) which are the same as blocks 10 in every way, except that the upper surface is generally smooth or planar to form the top of a retaining wall.

The arrangement shown in FIG. 3 is for illustrative purposes since, for most applications, the front faces of all the blocks in a retaining wall will be either vertically aligned, or vertically offset. However, for architectural interest, a mixture of these arrangements is possible with the blocks of this invention.

Figure 4:
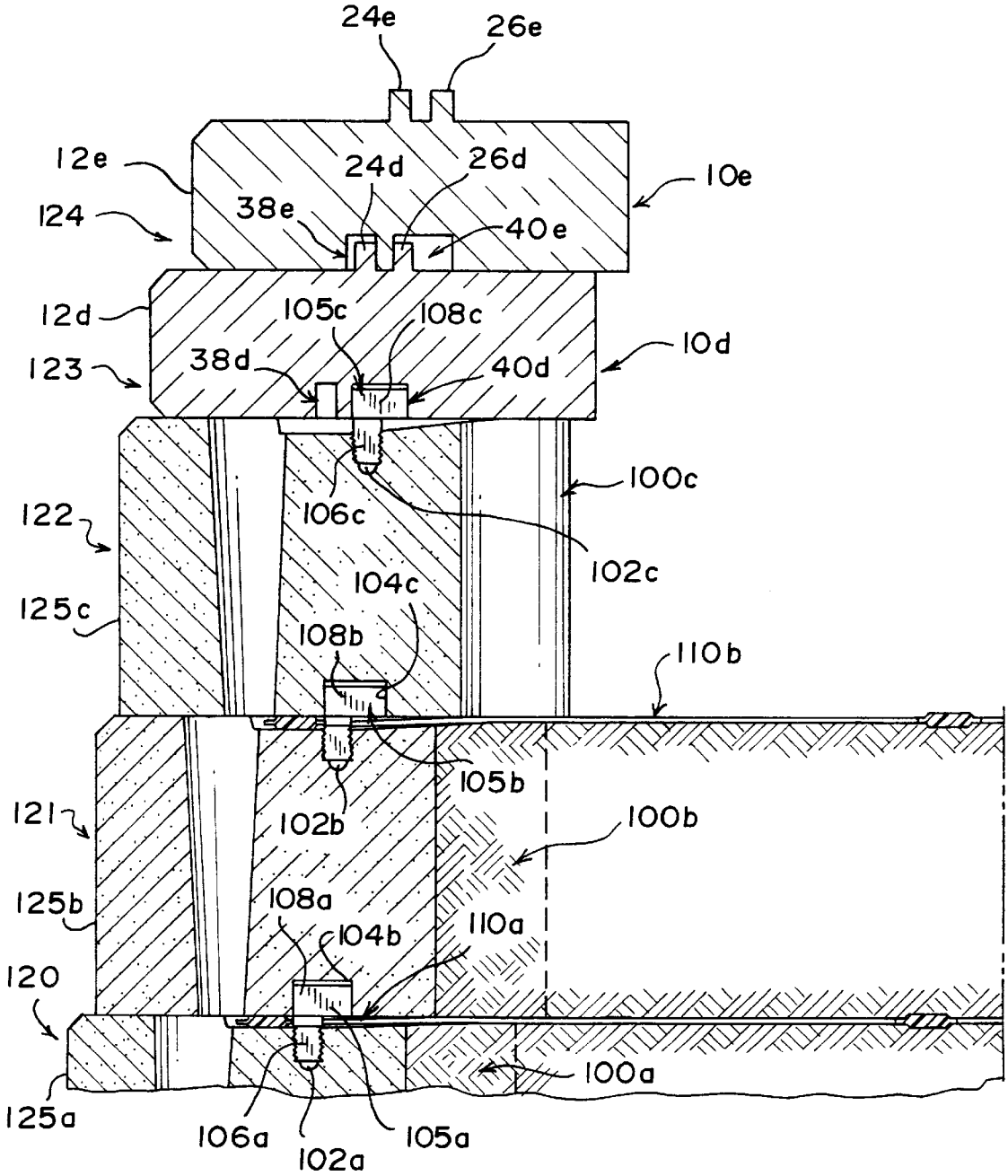
FIG. 4 is a schematic side elevational view showing the manner in which the inventive wall blocks of the present invention may be integrated with courses of wall blocks of the type using a comb or connector therebetween, the blocks of each successive course having their front faces rearwardly offset for structural stability of the retaining wall and/or architectural design.
Figure 5:
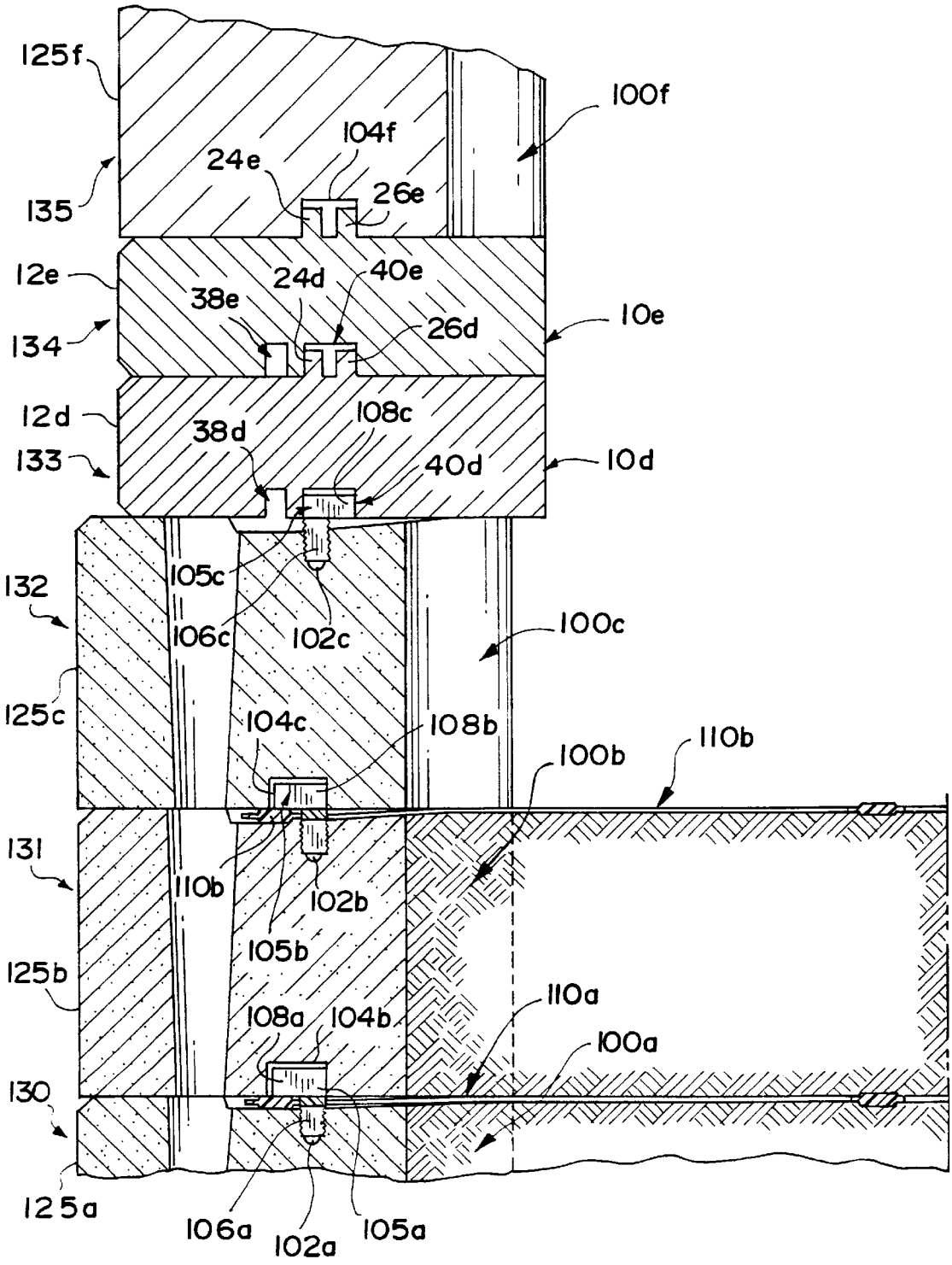
FIG. 5 is a view similar to FIG. 4 in which the front faces of selective courses of the wall blocks are vertically aligned with each other, while the front faces of other courses are vertically offset.

Wall blocks according to the present invention may be used in conjunction with wall blocks of the type disclosed in U.S. Pat. No. 5,540,525 or patent application Ser. Nos. 08/370,324(now U.S. Pat. No. 4,860,505), 08/591,266 (now U.S. Pat. No. 5,673,530) or 08/591,319. In FIGS. 4 and 5, courses of wall blocks 100 of the type as seen particularly in application Ser. No. 08/370,324 (now U.S. Pat. No. 4,860, 505) are integrated with courses of wall blocks 10 of the type disclosed herein. The wall blocks 100 each include an upwardly opening groove 102 and a wider downwardly opening groove or slot 104. A connector device or comb 105 includes a plurality of downwardly projecting serrated fingers 106 and a plurality of enlarged and offset tabs 108 extending above the fingers 106.

The fingers 106 may be inserted through apertures in the end of a sheet 110 of grid-like reinforcing material and into the groove 102 in the upper surface of a wall block 100 to secure the reinforcing sheet thereto, the upper surface of the wall blocks 100 being cut back or recessed as seen at 112 to accommodate the grid-like sheet 110.

As shown in FIG. 4, between courses 120 and 121 and 121 and 122, the combs 105*a*, 105*b*, respectively, have portions of their tabs 108*a*, 108*b* projecting rearwardly of their fingers 106*a*, 106*b*. With the combs oriented in this manner, when the tabs 108*a*, 108*b* are received in the slots 104*b*, 104*c*, respectively, of superimposed wall blocks, the front faces 125*a*, 125*b*, 125*c* of the blocks 100*a*, 100*b*, 100*c*, are vertically offset.

Likewise, with the comb 105*c* oriented in the same fashion, tabs 108*c* may be received in the enlarged downwardly opening groove 40*d* of a block 10*d* according to the instant inventive concepts, to offset the front faces 125*c* and 12*d* between the courses 122 and 123.

A further course 124 of modular wall blocks 10*e* according to this invention may then be positioned as in the upper course of FIG. 3 to offset the front faces 12*d* and 12*e* of the wall blocks in courses 123 and 124, and additional courses of either type of wall block can be added to attain the full height of the retaining wall.

With respect to FIG. 5, a retaining wall is schematically illustrated having three lower courses 130, 131 and 132 of wall blocks 100*a*, 100*b* and 100*c* of the type disclosed in application Ser. No. 08/370,324(now U.S. Pat. No. 4,860, 505), two courses, 134 and 135, of wall blocks 10*d* and 10*e* according to the instant invention, and an additional course 135 of wall blocks 100*f* of the previous type, for architectural interest. In this arrangement, the combs 105*a* and 105*b* between courses 130 and 131, and 131 and 132, respectively, are reversed from the orientation seen in FIG. 4 thereby vertically aligning the front faces 125*a*, 125*b* and 125*c* in courses 130, 131 and 132. The comb 105*c* may be oriented as in FIG. 4 to offset the blocks 10*d* and 10*e* in courses 133 and 134, if desired for architectural interest, and then one or more further courses, such as shown at 135, of the earlier style blocks schematically illustrated at 100*f*, may be provided, as necessary.

Thus, it will now be recognized that the wall blocks 10 of the present invention may form upper or intermediate courses integrated with wall blocks according to the earlier inventions in order to minimize cost or to enhance the architectural interest of a retaining wall.

Figure 6:
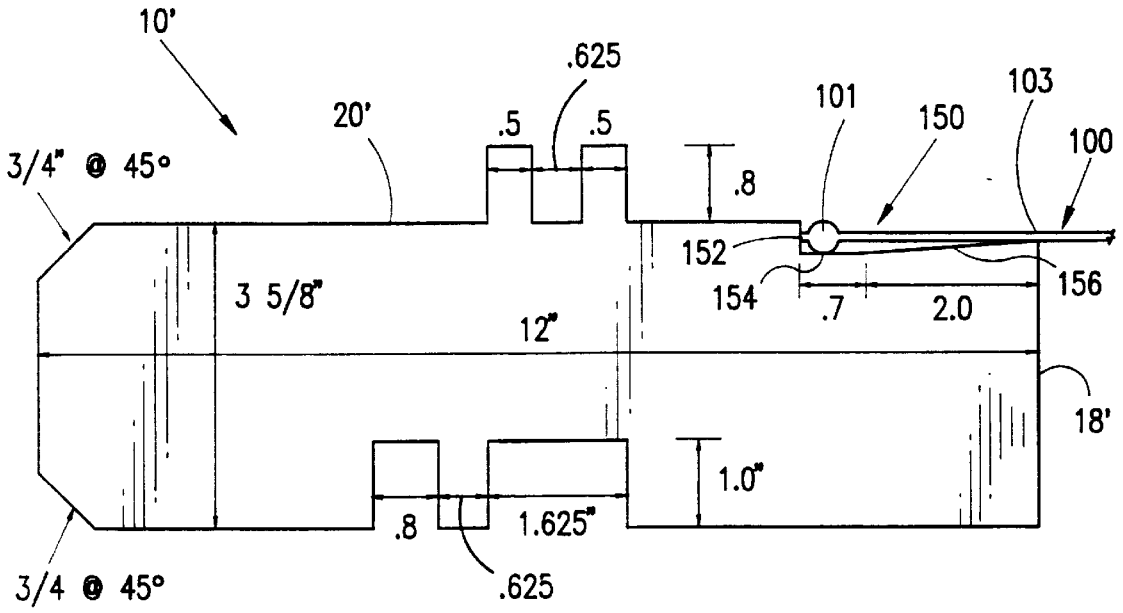
FIG. 6 is a side elevational view similar to FIG. 1 of a modular wall block according to an alternate embodiment of the instant inventive concepts wherein a recess is provided in the rear of the upper surface thereof to accommodate the end portions of a grid-like sheet of reinforcing material.
Figure 7:
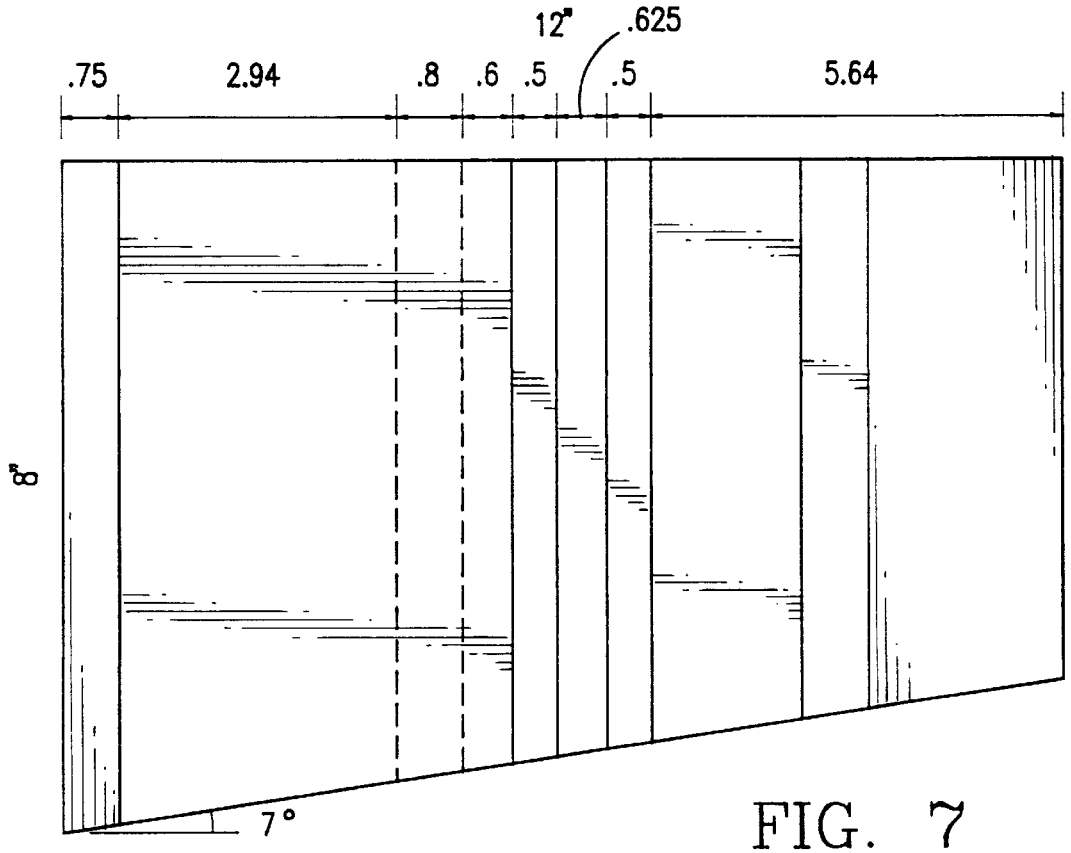
FIG. 7 is a top plan view thereof.
Figure 8:
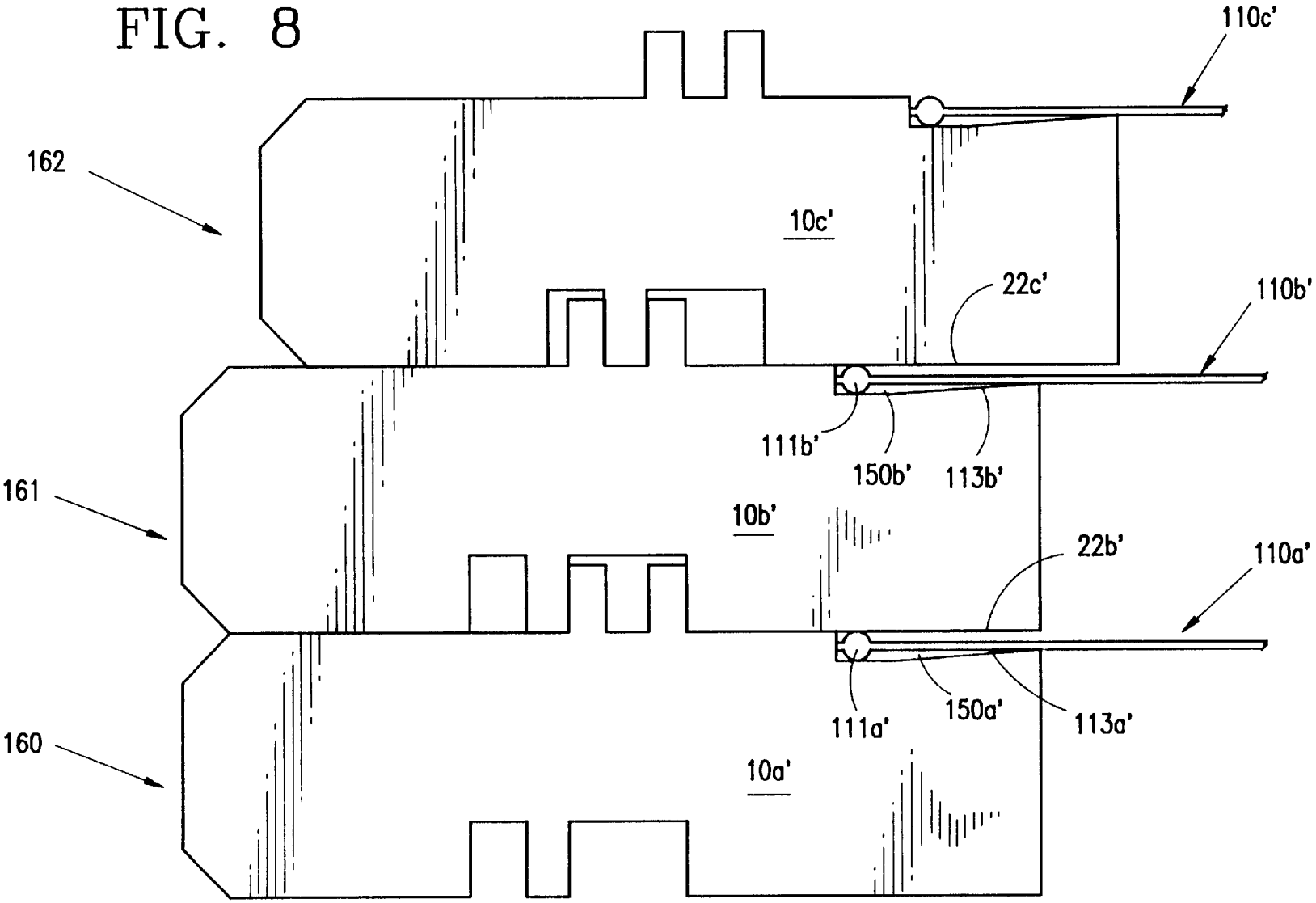
FIG. 8 is a side elevational view similar to FIG. 3 showing the manner in which three courses of wall blocks of the type shown in FIG. 6 may be stacked with sheets of grid-like reinforcing material captured therebetween.

In FIGS. 6–8, an alternate, slightly modified embodiment 10' of the wall block of the present invention is shown wherein a recess 150 is provided in the rearward portion of the upper surface 20', extending to the rear surface 18'. The leading edge 152 of the recess 150 is approximately 0.70 inches deep. A horizontally extending surface 154 preferably defines the portion of the recess 150 extending rearwardly from the leading edge 152 until intersecting surface 156 which tapers upwardly at a slight inclination for approximately 2 inches until reaching rear surface 18'.

This embodiment of wall block 10' is desirable in constructing walls of a height above approximately 4 feet. With such walls, the recess 150 accommodates the rearward edge portion of a grid-like sheet 110 of reinforcing material such as a uniaxially oriented integral geogrid comprising bars 111 and strands 113, together defining a plurality of openings in a well known manner. The strands 113 extend rearwardly from the bars 111 and into fill material behind a wall formed by blocks of the present invention. The forward most bar 111 of the sheet 110 rests in the portion 154 of the recess 150 and a superimposed wall block captures the sheet 110 in the recess 150.

This is best shown in FIG. 8 where a plurality of blocks 10*a*', 10*b*' and 10*c*' form successive superimposed courses 160, 161, 162. As is seen between blocks 10*a*' and 10*b*', the forward edge portions of the reinforcing sheet 110*a*' is received between the lower surface 22*b*' of block 10*b*' and the tapered opening formed by recess 150*a*', serving to retain bar 111*a*' and, thereby, the length of sheet material 110*a*' extending rearwardly therefrom. The same entrapment of the reinforcing sheet occurs where the front faces 12*a*', 12*b*' of the blocks are in a vertically aligned orientation as seen in courses 160 and 161 or, where the front faces 12*b*', 12*c*' of the blocks are in a vertically offset orientation as seen in courses 161, 162.

Figure 9:
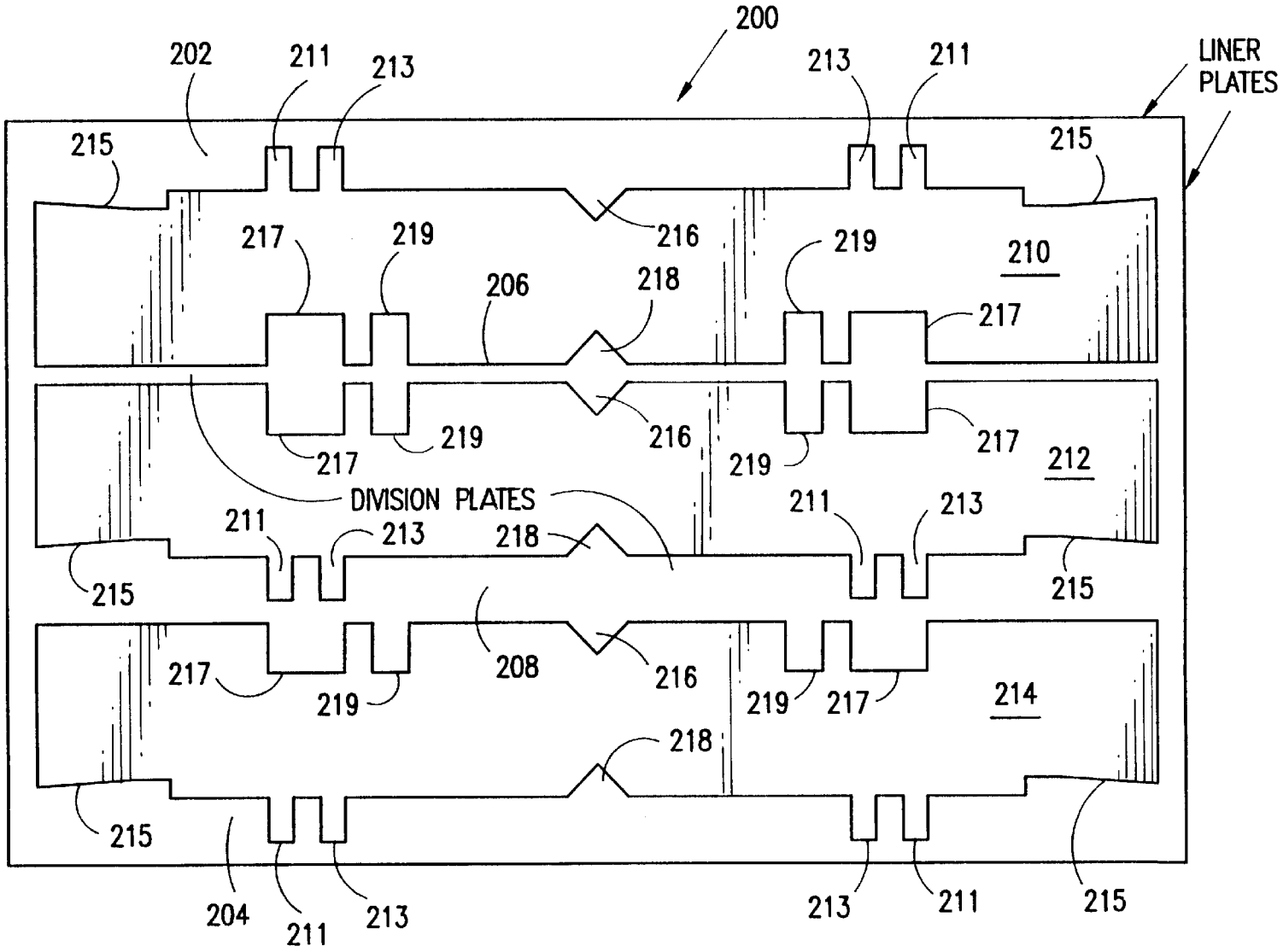
FIG. 9 is a schematic top plan view of one form of mold adapted to produce six modular wall blocks on their side according to a preferred manufacturing technique of the instant inventive concepts.

Referring now particularly to FIG. 9, in forming a plurality of blocks such as 10' shown in FIG. 6, a mold 200 is preferably used. In this example, six blocks 10' will be formed. It is understood that block 10 as shown in FIG. 1 is formed in a similar manner, but without the formation of a recess 150 in the rear portion of the upper surface 20 thereof.

In mold 200, the configuration of the liner plates 202 and 204 forms outermost edge portions of the upper surfaces of two interconnected double-blocks. Located between the two edge portions 202 and 204 are division plates 206 and 208. Division plate 206 is used to shape the lower surface of two double-blocks 210, 212, whereas the division plate 208 includes the formation of an upper surface of the double-block 212 on one side and the lower surface of a further double-block 214 on the other side.

By the arrangement of the mold parts shown, three elongated double-blocks 210, 212 and 214 are formed, each of which includes spaced projections 211, 213 and recesses 215 in one surface and spaced grooves 217, 219 in the other surface. At the center of each of the elongated double-blocks triangular notches 216, 218 are located on opposite sides. After the double-blocks are removed from the mold 200, a wedge is applied to the triangular notches to split the double blocks into six individual blocks 10' such as seen at FIG. 6. Each block of this type will have an aesthetically pleasing roughened front face.

It is understood that the mold could be readily modified to produce more or less double-blocks which can be split to produce the modular wall blocks of the instant invention.

This technique of forming the wall blocks of this invention on their side is particularly efficient in permitting the production of multiple wall blocks in the same size mold box as was used heretofore to produce only a single block because the footprint of the sides of the blocks of this invention is substantially smaller than the footprint of the top and bottom surfaces. With the techniques shown in FIG. 9, the bottom of the mold can be flat to produce the flat side of the resultant wall blocks, and the upper molding member (not shown) can include portions adapted to impress the taper into the other side of the wall blocks and to push the double-blocks from the mold when the concrete has set sufficiently, and the bottom plate has been withdrawn.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A modular wall block system to be used for forming a retaining wall, said modular wall block system comprising:

a plurality of wall blocks each having a front face for forming a portion of an exterior surface of the retaining wall, a rear face, top and bottom surfaces, and opposed sidewalls extending between said top and bottom surfaces and said front and rear faces, said top surface of each wall block including a pair of integral, transverse, upwardly extending projections spaced from said front face, and spaced from each other by an upwardly opening groove, said bottom surface of each wall block including a pair of transverse, downwardly opening grooves of different widths spaced from said front face, and spaced from each other by a downwardly extending projection, said upwardly extending projections and said upwardly opening groove in said top surfaces of selected wall blocks adapted to cooperate with said downwardly opening grooves and said downwardly extending projection in said bottom surfaces of other wall blocks such that superimposed courses of wall blocks may be selectively integrated in the formation of a retaining wall therefrom with said front faces in one of a vertically aligned and a vertically offset orientation.

2. A modular wall block system as claimed in claim 1, wherein the width of said upwardly opening groove is at least as large as the width of said downwardly extending projection.

3. A modular wall block system as claimed in claim 1, wherein the rearward portion of said top surface of each block further includes a recess for receipt of forwardmost edge portions of extended lengths of grid-like sheet material.

4. A retaining wall comprising:

a plurality of courses of superimposed wall blocks, each course including a plurality of laterally juxtaposed wall blocks each of which has a front face for forming a portion of an exterior surface of the retaining wall, a rear face, top and bottom surfaces, and opposed sidewalls extending between said top and bottom surfaces and said front and rear faces, said top surface of each wall block in at least one course including a pair of integral, transverse, upwardly extending projections spaced from said front face, and spaced from each other by an upwardly opening groove, said bottom surface of each wall block in said at least one course including a pair of transverse, downwardly opening grooves of different widths spaced from said front face, and spaced from each other by a downwardly extending projection, said projections and said grooves in said wall blocks in said at least one course cooperating with complementary elements in wall blocks in superior and inferior courses such that superimposed courses of wall blocks are selectively integrated in the formation of the retaining wall with said front faces in one of a vertically aligned and a vertically offset orientation.

5. A retaining wall as claimed in claim 4, wherein the width of said upwardly opening groove is at least as large as the width of said downwardly extending projection.

6. A retaining wall as claimed in claim 5, comprising a plurality of juxtaposed courses of wall blocks including said projections and said grooves, wherein said downwardly extending projections of wall blocks in superior courses any received in said upwardly opening grooves in wall blocks in inferior courses.

7. A retaining wall as claimed in claim 4, comprising a plurality of juxtaposed courses of wall blocks including said projections and said grooves, wherein both said projections on said top surface of wall blocks in inferior courses are received within said one downwardly opening groove in said bottom surfaces of wall blocks in superior courses.

8. A retaining wall as claimed in claim 4, wherein the rearward portion of said top surface of each block further includes a recess for receipt of forwardmost edge portions of extended lengths of grid-like sheet material.

9. A retaining wall as claimed in claim 8, wherein said recess terminates at said rear face of said wall block.

10. A retaining wall as claimed in claim 4 wherein the wall blocks in all of said courses each include said projections and said grooves.

11. A retaining wall as claimed in claim 4 wherein said complementary elements in said blocks of at least some of said courses are provided by connector elements secured to the top surface of wall blocks in selected inferior courses, said connector elements including a plurality of elongated upstanding tab members received in the larger of said downwardly opening grooves in the bottom surfaces of the wall blocks in a superimposed course.

12. A retaining wall as claimed in claim 11, wherein said connector elements include a plurality of downwardly extending finger members secured in an upwardly opening transverse groove in the top surface of the wall blocks in said inferior courses.

13. A retaining wall as claimed in claim 12, further including grid-like sheets of reinforcing material extending rearwardly behind selected courses of said wall blocks in said retaining wall, the forwardmost portion of said sheets defining a plurality of apertures, and at least some of said sheets being secured between juxtaposed courses of wall blocks in said retaining wall by said finger members of a connector element passing through said apertures and being retained in said upwardly opening transverse groove in said top surfaces of wall blocks forming said inferior courses.

14. A modular wall block system to be used for forming a retaining wall, said modular wall block system comprising:

a plurality of wall blocks each having a front face for forming a portion of an exterior surface of the retaining wall, a rear face, top and bottom surfaces, and opposed sidewalls extending between said top and bottom surfaces and said front and rear faces, said top surface of each wall block including a pair of integral, transverse, upwardly extending projections spaced from said front face, and spaced from each other by an upwardly opening groove, said bottom surface of each wall block including a pair of transverse, downwardly opening grooves of different widths spaced from said front face, and spaced from each other by a downwardly extending projection, said upwardly extending projections and said upwardly opening groove in said top surfaces of selected wall blocks adapted to cooperate with said downwardly opening grooves and said downwardly extending projection in said bottom surfaces of other wall blocks such that superimposed courses of wall blocks may be selectively integrated in the formation of a retaining wall therefrom with said front faces in one of a vertically aligned and a vertically offset orientation, and a width of one of said downwardly opening grooves being at least as large as a combined width of said upwardly extending projections and said upwardly opening groove.

15. A modular wall block system as claimed in claim 14, wherein the width of said upwardly opening groove is at least as large as the width of said downwardly extending projection.

16. A modular wall block system as claimed in claim 14, wherein the rearward portion of said top surface of each block further includes a recess for receipt of forwardmost edge portions of extended lengths of grid-like sheet material.

17. A retaining wall comprising:

a plurality of courses of superimposed wall blocks, each course including a plurality of laterally juxtaposed wall blocks each of which has a front face for forming a portion of an exterior surface of the retaining wall, a rear face, top and bottom surfaces, and opposed sidewalls extending between said top and bottom surfaces and said front and rear faces, said top surface of each wall block in at least one course including a pair of integral, transverse, upwardly extending projections spaced from said front face, and spaced from each other by an upwardly opening groove, said bottom surface of each wall block in said at least one course including a pair of transverse, downwardly opening grooves of different widths spaced from said front face, and spaced from each other by a downwardly extending projection, said projections and said grooves in said wall blocks in said at least one course cooperating with complementary elements in wall blocks in superior and inferior courses such that superimposed courses of wall blocks are selectively integrated in the formation of the retaining wall with said front faces in one of a vertically aligned and a vertically offset orientation, and a width of one of said downwardly opening grooves being at least as large as a combined width of said upwardly extending projections and said upwardly opening groove.

18. A retaining wall as claimed in claim 17, wherein the width of said upwardly opening groove is at least as large as the width of said downwardly extending projection.

19. A retaining wall as claimed in claim 17, comprising a plurality of juxtaposed courses of wall blocks including said projections and said grooves, wherein said downwardly extending projections of wall blocks in superior courses are received in said upwardly opening grooves in wall blocks in inferior courses.

20. A retaining wall as claimed in claim 17, comprising a plurality of juxtaposed courses of wall blocks including said projections and said grooves, wherein both said projections on said top surface of wall blocks in inferior courses are received within said one downwardly opening groove in said bottom surfaces of wall blocks in superior courses.

21. A retaining wall as claimed in claim 17, wherein the rearward portion of said top surface of each block further includes a recess for receipt of forwardmost edge portions of extended lengths of grid-like sheet material.

22. A retaining wall as claimed in claim 21, wherein said recess terminates at said rear face of said wall block.

23. A retaining wall as claimed in claim 17, wherein the wall blocks in all of said courses include said projections and said grooves.

24. A retaining wall as claimed in claim 17, wherein said complementary elements in said blocks of at least some of said courses are provided by connector elements secured to the top surface of wall blocks in selected inferior courses, said connector elements including a plurality of elongated upstanding tab members received in the larger of said downwardly opening grooves in the bottom surfaces of the wall blocks in a superimposed course.

25. A retaining wall as claimed in claim 24, wherein said connector elements include a plurality of downwardly extending finger members secured in an upwardly opening transverse groove in the top surface of the wall blocks in said inferior courses.

26. A retaining wall as claimed in claim 25, further including grid-like sheets of reinforcing material extending rearwardly behind selected courses of said wall blocks in said retaining wall, the forwardmost portion of said sheets defining a plurality of apertures, and at least some of said sheets being secured between juxtaposed courses of wall blocks in said retaining wall by said finger members of at least one of said connector elements passing through said apertures and being retained in said upwardly opening transverse groove in said top surfaces of wall blocks forming said inferior courses.

* * * * *